US005752139A

United States Patent [19]

Sumikawa et al.

[11] Patent Number: 5,752,139

[45] Date of Patent: May 12, 1998

[54] DUAL-COMPONENT MAGNETIC BRUSH DEVELOPING DEVICE

[75] Inventors: Takeshi Sumikawa; Isao Ito, both of Ashigarakami-gun, Japan

[73] Assignee: Fuji Xerox Co., Ltd., Tokyo, Japan

[21] Appl. No.: 754,935

[22] Filed: Nov. 25, 1996

[30] Foreign Application Priority Data

Nov. 27, 1995 [JP] Japan ..... 7-329414

[51] Int. Cl.[6] ..... G03G 15/09; G03G 15/095

[52] U.S. Cl. ..... 399/264; 399/273; 399/278; 399/288

[58] Field of Search ..... 399/264, 273, 399/278, 280, 283, 288

[56] References Cited

U.S. PATENT DOCUMENTS

| | | | |
|---|---|---|---|
| 3,901,187 | 8/1975 | Hudson | 399/264 X |
| 3,920,329 | 11/1975 | Dennie et al. | 399/264 |
| 4,660,958 | 4/1987 | Egami et al. | 399/273 |
| 4,714,046 | 12/1987 | Steele et al. | 399/236 |
| 4,804,995 | 2/1989 | Osawa et al. | 399/273 |
| 4,833,503 | 5/1989 | Snelling | 399/231 |
| 5,065,192 | 11/1991 | Adkins et al. | 399/273 |
| 5,095,340 | 3/1992 | Mahoney | 399/230 |
| 5,227,848 | 7/1993 | Robinson et al. | 399/273 X |
| 5,592,265 | 1/1997 | Sakuraba et al. | 399/285 |

FOREIGN PATENT DOCUMENTS

| | | |
|---|---|---|
| 57-190974 | 11/1982 | Japan . |
| 5-59427 | 8/1993 | Japan . |
| 7-84456 | 3/1995 | Japan . |

*Primary Examiner*—Nestor R. Ramirez
*Attorney, Agent, or Firm*—Oliff & Berridge, P.L.C.

[57] ABSTRACT

A dual-component magnetic brush developing device using a dual-component developer containing magnetic carriers and toner electrically attracted to the magnetic carriers. The dual-component magnetic brush developing device comprises: a magnetic field generation member being formed with a plurality of magnetic poles almost equally spaced from each other on a peripheral surface; a developer transport member being supported outside the magnetic field generation member for circumferential rotation and moving together with the magnetic field generation member at least in a developing area facing the image carrier in the proximity thereof; toner supply means for supplying an excess of new toner to magnetic carriers supported on the developer transport member and passing through the developing area; magnetic field reduction unit for reducing a magnetic field strength in the vicinity of a surface of the developer transport member by an agitation section for agitating the developer to which the excessive toner is supplied; and excessive toner separation unit being disposed downstream from the agitation section in a circumferential rotation direction of the developer transport member for separating excessive toner from the magnetic carriers supported on the developer transport member.

13 Claims, 8 Drawing Sheets

DUAL-COMPONENT MAGNETIC BRUSH DEVELOPING DEVICE

BACKGROUND OF THE INVENTION

This invention relates to a dual-component magnetic brush developing device which uses a dual-component developer containing magnetic carriers and toner electrically attracted to the magnetic carriers and selectively transfers toner in the dual-component developer to a latent image formed on an image carrier (photosensitive body) for visualizing the latent image.

In electrophotographic techniques, a developing method using a dual-component developer containing toner and magnetic carriers has the advantages that toner is easily charged and that agglomeration of toner particles is hard to occur. Thus, hitherto, the method has been widely used although it requires control of the toner amount contained in the dual-component developer, namely, the toner concentration.

In the developing device using a dual-component developer, how the toner concentration and the toner charge amount can be controlled accurately becomes important. For example, if the toner concentration is too low, the print image density becomes insufficient; if the toner concentration is too high, a toner cloud easily occurs, leading to ground dirt of a print image or dirt in the developing device.

The proper range of the toner concentration depends on the toner charge amount. For example, if the toner concentration is the same, the print image density when the toner charge amount is high becomes lower than that when the toner charge amount is low. The reasons are that since the electrostatic adhesion force of toner to carriers increases when the toner charge amount is high, the developing property lowers, that the number of toner particles required for saturation development of an electrostatic latent image lessens, etc. If the toner concentration is the same, a toner cloud when the toner charge amount is low occurs more easily than that when the toner charge amount is high, because the electrostatic adhesion force of toner to carriers lessens when the toner charge amount is low.

Therefore, to control the toner concentration, it is important to grasp the charge property of a developer. If the charge property of a developer changes largely with the environment or time, even if the toner concentration is controlled constant, it is insignificant. For example, available as toner concentration control methods are methods of replenishing a developer with toner as much as the amount of used toner, such as a quantitative replenishment method of replenishing toner in response to the print amount and a method of sensing the toner amount in a developer and replenishing the developer with toner. However, when the charge property of the developer changes, if the toner concentration is controlled to a predetermined toner concentration, the toner charge amount does not necessarily become a predetermined value; if the toner concentration is controlled accurately, the effect as expected is not produced.

To solve such a problem, for example, a method of actually sensing the development toner amount on an image carrier and replenishing the developer with toner is available. From the point of directly sensing the development toner amount, namely, the development concentration and controlling the toner concentration in the developer, the method produces a larger effect than the above-mentioned methods of replenishing the developer with toner as much as the amount of used toner.

However, if the toner amount in the developer is sensed or the development toner amount on an image carrier is sensed for controlling the toner concentration as described above, costs of the device will increase. Since toner replenishment is only executed in the toner concentration control method, the toner concentration cannot be lowered if it becomes higher than a predetermined value.

On the other hand, most of the conventional dual-component magnetic brush developing devices are provided with a space for mixing and agitating a developer in a housing for sufficiently agitating the developer replenished with toner in the housing. However, the device is upsized by thus providing the space for mixing and agitating a developer. In recent years, demand for downsizing the device has been increasing and the conventional dual-component developing devices as described above cannot respond to such demand.

Under such circumstances, developing devices are proposed in Postexamined Japanese Patent Publication 5-59427 and Unexamined Japanese Patent Publication 7-84456, for example, wherein the space surrounding a developing roll is limited narrow and a small amount of developer is poured in the space for developing, then the developer is replenished with toner whenever necessary. These developing devices enable downsizing and control the toner concentration by a simpler structure.

In the technique disclosed in the Publication 5-59427, the point or head of a magnetic brush on a sleeve is scrubbed with toner in a toner hopper through a mesh screen, whereby the adhesion amount of toner to magnetic carriers is made stable and the toner concentration is controlled to an almost constant value.

In the technique disclosed in the Publication 7-84456, a developing roller is surrounded by a narrow space and the carrier amount in the space is made almost constant, whereby the amount of magnetic toner stored in the remaining space is adjusted for controlling the toner concentration to an almost constant value.

However, the developing devices as described above involve the following problems:

The developing device described in the Publication 5-59427 scrubs a developer through the mesh screen, thus a stress is imposed on the developer, resulting in drastic lowering of the lifespan of the developer. Since the flow property of toner or the toner charge property, namely, adhesion force of toner and carriers contribute largely to control of the toner concentration, if the flow property or charge property of toner changes with the environment or time, the toner concentration control range is placed out of the initially setup range and the print image quality becomes different from the initial one.

Application where solid images having gradation, such as photos, pictures, or maps, are mainly printed and application where line images are mainly printed differ largely in replenished toner amount; since the contract area between carriers and toner is limited in the mesh screen method, when the replenished toner amount largely changes, it becomes difficult to maintain the toner concentration constant.

On the other hand, to use magnetic toner, the developing device described in the Publication 7-84456 requires that magnetic power be contained in toner; color toner cannot be used from the coloring property problem. If an attempt is made to non-magnetize toner to overcome the disadvantage, the disclosed technique does not provide the developing device function. That is, if nonmagnetic toner is used with the developing device, nonmagnetic toner and magnetic carriers are not agitated and are stored in a narrow space, so that toner is charged insufficiently. The toner, which is free of a scatter prevention function of a magnetic force, easily becomes a cloud. Thus, a large amount of toner cloud occurs and appears on an image as fog and prints of a good image quality cannot be provided.

Further, the developing devices disclosed in the Publication 5-59427 and 7-84456 are designed to always attract carriers magnetically on the surface of the developing roll; carriers are formed like ears on the developing roll. Thus, the effective charge area of carriers decreases and charge-failure toner becomes prone to occur. If a developer is replenished with new toner on the developing roll, the toner is hard to be uniformly mixed with the developer and concentration unevenness is also prone to occur in a visualized image.

SUMMARY OF THE INVENTION

It is therefore an object of the invention to provide a developing device that can control the toner concentration and toner charge amount in a dual-component developer by a simple structure and provide good image quality even if nonmagnetic toner is used, or a developing device that can be downsized and promptly agitate a developer replenished with toner for removing toner concentration evenness.

To the end, according to the invention, there is provided a dual-component magnetic brush developing device using a dual-component developer containing magnetic carriers and toner electrically attracted to the magnetic carriers for selectively transferring the toner to an electrostatic latent image formed on an image carrier for visualizing the latent image, the dual-component magnetic brush developing device comprising a magnetic field generation member being formed with a plurality of magnetic poles almost equally spaced from each other on the peripheral surface and being supported so that the peripheral surface makes a circumferential rotation move, a developer transport member being supported outside the magnetic field generation member for circumferential rotation and moving together with the magnetic field generation member at least in a developing area facing the image carrier in the proximity thereof, toner supply means for supplying an excess of new toner to magnetic carriers supported on the developer transport member and passing through the developing area, magnetic field reduction means for reducing the magnetic field strength in the vicinity of the surface of the developer transport member by an agitation section for agitating the developer to which the excessive toner is supplied, and excessive toner separation means being disposed downstream from the agitation section in a circumferential rotation direction of the developer transport member for separating excessive toner from the magnetic carriers supported on the developer transport member.

In the invention, the magnetic field generation member may be made of any material normally used as a permanent magnet, such as a metal magnet comprising a metal material like ferrite, magnetite, or iron magnetized, a plastic magnet comprising magnetite or ferrite powder dispersed in a polymer and magnetized, or a sheet magnet of a sheet comprising magnetite or ferrite powder dispersed in a polymer or rubber and magnetized, if it generates a magnetic field to which magnetic carriers are attracted.

It is desirable that the magnetic field generation member has magnetic poles magnetized at pitches of 3 mm or less, preferably 2 mm or less. It is desirable that the magnetic poles are placed as an alternating pattern of N and S poles. However, even if they are irregularly magnetized, the poles can be set appropriately if the difference between magnetic brush point or head heights on the magnetic pole and between the magnetic poles can be lessened.

For the dual-component developer, a known one can be used appropriately. The toner may be magnetic or nonmagnetic. For the carriers, known ones can also be used, such as metal particle carriers comprising metal fine particles of ferrite, magnetite, or iron or the metal fine particle surfaces coated with a polymer or polymer carriers comprising magnetic power contained in a polymer.

The dual-component magnetic brush developing device of the configuration according to the invention functions as follows:

Since the dual-component magnetic brush developing device according to the invention comprises the magnetic field generation member supported for circumferential rotation and formed with a plurality of magnetic poles along the peripheral surface and the developer transport member supported outside the magnetic field generation member for circumferential rotation, a magnetic brush of a developer with ears of magnetic carriers is formed on the developer transport member by the magnetic force of the magnetic field generation member and is transported as the developer transport member and the magnetic field generation member make a circumferential rotation move. Thus, tumbling of the developer is hard to occur and toner cloud generation is decreased as compared with the conventional method by which a magnetic force generation member is contained in a nonmagnetic developer transport member and with the magnetic force generation member fixed, the developer transport member is moved for transporting a developer while tumbling the developer or the conventional method by which a magnetic force generation member and a developer transport member are moved in the same direction or opposite directions for transporting a developer while tumbling the developer. Therefore, the developer toner concentration can be set high. That is, if the developing property itself lowers although magnetic brush tumbling is hard to occur, setting the developer toner concentration high can make up for lowering the developing property. Since tumbling is hard to occur, a stress imposed on the developer also lessens and degradation of the developer is prevented.

In the developing device according to the invention, a plurality of magnetic poles are magnetized in almost equal spacing along the peripheral surface of the magnetic field generation member; for example, if magnetic poles different in polarity are adjacent, a magnetic brush is formed on the developer transport member in response to the magnetic pole pitches. At this time, if the magnetic pole pitch of the magnetic field generation member is large, the magnetic brush point or head is high in the portion corresponding to the top of the magnetic pole of the magnetic field generation member and is low in the portion corresponding to the area between the magnetic poles of the magnetic field generation member. The magnetic pole pitch is set small (3 mm or less), whereby the difference between the magnetic brush point or head heights on the magnetic pole and between the magnetic poles is almost removed. Thus, image density unevenness caused by the top or head height difference of the magnetic brush is eliminated and images of good image quality can be provided.

In the developing device of the invention, since the agitation section for supplying new toner to the developer supported on the developer transport member and passing through the developing area and agitating the toner and developer is provided with the magnetic field reduction means for reducing the magnetic field strength in the vicinity of the surface of the developer transport member, the magnetic force of the magnetic field generation member is hard to act on the developer in the agitation section and the developer is stripped off from the developer transport member. Thus, in the agitation section, the magnetic restraint force of the magnetic field generation member scarcely affects the developer and magnetic carriers are separated. Thus, the effective charge areas of the carrier and toner can be enlarged and new toner can be charged sufficiently. A guide member for guiding the developer transport member so that the developer transport member moves away from the surface of the magnetic field generation member or a magnetic member placed between the magnetic field generation member and the developer transport member can be used as the magnetic field reduction means. If the developer is stripped off by the magnetic field reduction means, a stress is hard to be imposed on the developer and a problem of lowering the developer lifespan does not arise as compared with the case where a developer is stripped off mechanically by means of a so-called scraper.

When a developer is agitated, lifespan lowering caused by a stress imposed on the developer is also at stake. In the invention, since the developer toner density in the agitation section is high and a large number of toner particles are deposited on carriers, the probability that toner intervenes between the carrier particles when developers collide with each other becomes high. Thus, the toner serves as a shock absorber and the stress imposed on one toner particle also lessens; developer lifespan lowering caused by agitating the developer does not occur.

Preferably, the developer toner concentration at this time is set so that the coverage percentage of the toner to carriers, f, exceeds 100%. Generally, the toner concentration is set to about 30% or more, whereby the coverage percentage f exceeds 100%, and new toner exceeding it is excessively supplied to the agitation section, whereby the stress imposed on the developer can be lessened and the toner can be agitated and mixed sufficiently with the developer after developing. Letting the average particle diameter of carriers be D (m), the average particle diameter of toner be d (m), the true density of carriers be ρc (kg/m$^3$), the true density of toner be ρt (kg/m$^3$), the toner weight contained in the developer be Wt (g), and the carrier weight contained in the developer be Wc (g), the toner coverage percentage f is shown by the following expression:

$$f=\frac{\sqrt{3}\times D\times p_c\times W_t}{2\times\pi\times d\times pt\times W_c}\times 100$$

The toner concentration TC is represented by the following expression:

$$TC\ (\%)=\{Wt/(Wt+Wc)\}\times 100$$

In the invention, the excessive toner separation means is disposed downstream from the agitation section in the circumferential rotation direction of the developer transport member for separating excessive toner from the magnetic carriers supported on the developer transport member. Thus, the developer separated from the developer transport member is mixed with excessive toner and the toner concentration is once increased, then excessive toner is separated while they are agitated.

The excessive toner separation means can be adapted to agitate a developer and screen out excessive toner in the developer by gravitation by shaking or shock resulting from agitating the developer. Charge-failure toner that cannot come in contact with carrier charge sites in the developer containing the excessive toner has a weak adhesion force to the carriers by an electrostatic force and is easily screened out by the shaking or shock resulting from agitating the developer. In contrast, toner coming in contact with carrier charge sites and charged adheres to the carriers by an electrostatic force and is not screened out by the shaking or shock resulting from agitating the developer. The toner is transported to the developing area as the magnetic field generation member and the developer transport member make a circumferential rotation move. That is, while the developer is being transported, the toner concentration in the developer can be controlled to a predetermined value and the toner charge amount can be controlled to an almost constant value. Thus, developing can be executed with sufficiently charged toner.

A plate-like member placed in contact with or in the proximity of the developer transport member along the developer transport member for once supporting a developer by the magnetic force of the magnetic field generation member can be used as the excessive toner separation means. In the excessive toner separation means of the plate-like member, as a magnetic field of the magnetic field generation member moves, tumbling occurs on the developer on the fixedly supported plate-like member, the developer is agitated and mixed, and charge-failure toner can be screened out. Excessive toner can be promptly separated by shaking the plate-like member.

In the developing device, an excess of toner is supplied in the agitation section where the magnetic field strength in the vicinity of the surface of the developer transport member is reduced, then excessive toner is separated from the developer. If a proper amount of toner is supplied and therefore the excessive toner separation means is not provided, the magnetic field generation member and the developer transport member can be provided for transporting the developer without causing tumbling and preventing a toner cloud from occurring. The magnetic field reduction means can be provided for easily stripping off the developer from the developer transport member and preventing degradation of the developer. Toner is supplied in the area where the magnetic field little acts, whereby carriers are dispersed and sufficient mixing, agitation, and toner charging are performed promptly. Therefore, toner concentration unevenness is eliminated and developing unevenness is prevented from occurring.

DETAILED DESCRIPTION OF PREFERRED EMBODIMENTS

Referring now to the accompanying drawings, there are shown preferred embodiments of the invention.

First Embodiment

Figure 1:
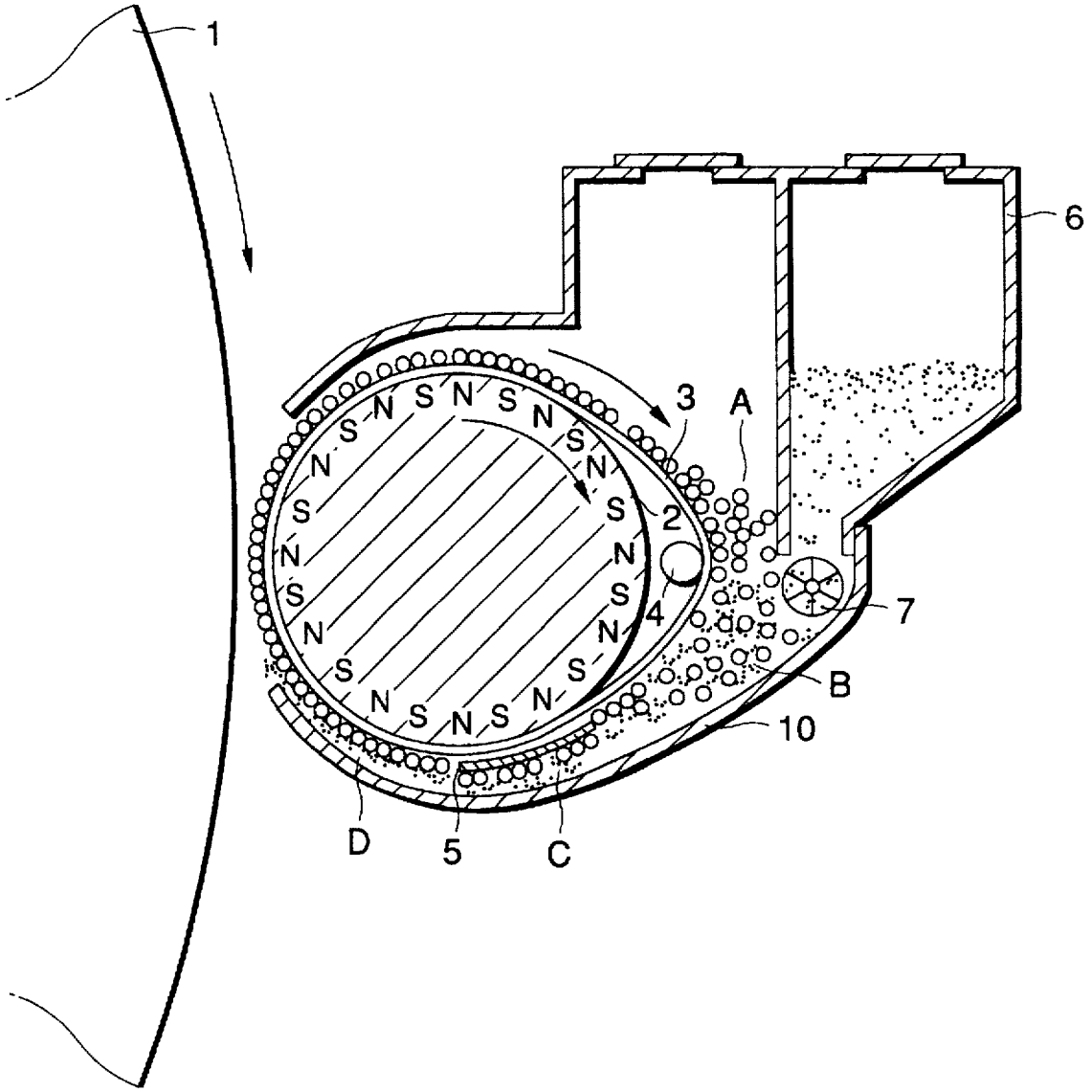
FIG. 1 is a schematic diagram to show the configuration of a developing device of first embodiment of the invention.

FIG. 1 is a schematic diagram to show the configuration of a developing device of first embodiment of the invention.

The development device comprises a magnetic field generation roller 2 disposed at a position facing an image carrier 1 having a surface on which a latent image can be formed owing to the charge potential difference, supported rotatably in a housing 10, and formed with magnetic poles along the peripheral surface of the magnetic field generation roller 2, an endless developer transport member 3 supported circulatably on the outside of the magnetic field generation roller 2 for transporting a magnetic brush of a dual-component developer while attracting it on the peripheral surface of the developer transport member 3, a guide member 4 for guiding the endless developer transport member 3 to move away from the surface of the magnetic field generation roller 2, and a plate-like member 5 placed in the proximity of the peripheral surface of the developer transport member 3 for once holding the developer by a magnetic force of the magnetic field generation roller 2. Further, a toner hopper 6 for storing toner and an agitation member 7 for agitating the developer at a position where toner is supplied from the toner hopper 6 are provided behind the developer transport member 3 in the housing 10.

The magnetic field generation roller 2 comprises an alternating pattern of magnetized N and S poles spaced 2 mm apart on the peripheral surface and is rotated in the arrow direction shown in the figure by drive means (not shown).

The endless developer transport member 3 is made of a nonmagnetic and conductive endless film and makes a circumferential rotation move following rotation of the magnetic field generation roller 2. The developer transport member 3 is supported so that it moves in intimate contact with the magnetic field generation roller 2 in a developing area opposed to the image carrier 1 and that it moves away from the surface of the magnetic field generation roller 2 by the guide member 4 in the housing 10.

The guide member 4 is disposed in the vicinity of agitation area B in which the developer passing through the developing area is agitated with new toner supplied from the toner hopper 6, and is adapted to set the developer transport member 3 away from the magnetic field generation roller 2 in the area B for decreasing the magnetic field strength in the vicinity of the surface. A power supply (not shown) for applying a developing bias voltage is connected to the guide member 4 for forming an electric field in the developing area with which the developer transport member 3 faces the image carrier 1 between.

The plate-like member 5 is made of a nonmagnetic member placed in the proximity of and along the developer transport member 3 and is supported fixedly downstream from the agitation area B in the move direction of the developer transport member 3. In area C in the proximity of the plate-like member 5, the magnetic force of the magnetic field generation roller 2 acts through the plate-like member 5, causing the developer to move on the plate-like member 5 fixedly supported.

The dual-component developer used with the developing device comprises polyester family toner with particle diameter 7 μm and magnetic polymer carriers each with particle diameter 55 μm mixed and adjusted to toner concentration 30 wt %. The physical properties of the toner and magnetic carriers will be discussed later.

In the developing device, when the magnetic field generation roller 2 is rotated, the developer transport member 3 makes a circumferential rotation move following the magnetic field generation roller 2. The magnetic force of the magnetic field generation roller 2 acts on a developer, forming a magnetic brush with ears of magnetic carriers to which toner adheres on the developer transport member 3. The magnetic brush is transported to the developing area as the developer transport member 3 moves, and toner in the magnetic brush is transferred to a latent image on the image carrier 1 in a developing electric field for developing the latent image. After the developing, as the developer transport member 3 makes a circumferential rotation move, the magnetic brush is transported to recovery area A in the housing 10.

In the recovery area A, a gap is provided between the developer transport member 3 and the magnetic field generation roller 2 by the guide member 4, thus the magnetic force acting on the developer lessens and the developer is stripped off from the magnetic field generation roller 2. Further, in the agitation area B, new toner is supplied to the stripped-off developer from the toner hopper 6 and they are mixed and agitated. Here, the magnetic force from the magnetic field generation roller 2 little acts and the developer particles come in contact with the new supplied toner in a state in which they get loose, so that the mix property with the toner is extremely good. The toner concentration of the developer at this time is not controlled and varies from 50 to 300 wt %; here, the toner coverage percentage becomes 100% or more.

When the developer in such a state is observed under an optical microscope, multiple layers of toner are deposited around the carriers. When the toner charge amount is measured while the toner around the carriers is blown out in order from the outside by air, the toner charge amount of the second layer to the outside deposited around the carriers is near 0 μC/g and the toner is barely charged and the charge-failure toner is extremely easily liberated from the carriers. The possible reason why the toner becomes charge failure is that the toner cannot come in direct contact with the carrier surfaces and thus is not charged by friction with the carriers. On the other hand, the toner charge amount of the first layer deposited around the carriers is near 10 μC/g and the toner is hard to be liberated from the carriers. The possible reason is that the toner can come in direct contact with the carrier surfaces and thus is charged by friction with the carriers and is deposited on the carriers by an electrostatic force.

The developer with multiple layers of toner deposited around the carriers is transported to the area C as the developer transport member 3 makes a circumferential rotation move. In the area C, the developer is attracted magnetically to the magnetic field generation roller 2 via the plate-like member 5. At this time, since the magnetic field generation roller 2 rotates, the developer is transported while it is being agitated by a magnetic force on the plate-like member 5, and charge-failure toner easily liberated from the developer is screened out by the agitation.

Further, in area D, the developer from which the charge-failure toner is removed forms a stable magnetic brush on the developer transport member 3 by the magnetic force of the developer transport member 3 and is transported to the developing area as the developer transport member 3 makes a circumferential rotation move. When the toner charge amount in the developer at this time is measured, it is near 10 μC/g and the toner concentration is near 30 wt %. Further, when the developer is measured under an optical microscope, almost one layer of toner is formed around the carriers.

The results of a print test carried out to check the function on the specific embodiment of the developing device shown in FIG. 1 will be discussed.

The data of the developing device used for the test is as shown below and the developing device is mounted in a general-purpose image formation system for carrying out the print test:

Image carrier 1: OPC (84 mm diameter)

ROS (Raster Output Scanner): LED (400 dpi)

Process speed: 100 mm/sec

Latent image potential: Background portion—600 V, image portion—100 V

Developer transport member 3:

Nonmagnetic endless film (which is 100 μm thick and comprises carbon black dispersed in polycarbonate resin. Electric resistance value=$10^8$ Ω·cm)

Magnetic field generation roller 2:

Magnetic flux density=22 mT (on developer transport member)

Roller diameter=20 mm

Roller peripheral speed=300 mm/s

Maximum spacing between developer transport member 3 and magnetic field generation roller 2=2 mm Spacing between image carrier 1 and developer transport member 3=0.5 mm Thickness of developer layer: 0.5 mm Developing bias:

DC component=−550 V

AC component=1.5 kvp-p (1.5 kHz)

Toner: Polyester family toner with particle diameter 7 μm

[Polyester (number-average molecular weight: 3,300, weight average molecular weight: 9,800, T g=60° C.) 93 wt % and carbon black 7 wt % are mixed, kneaded, and broken into fragments to produce paste toner with average particle diameter 7 μm, then 40 nm$TiO_2$ fine powder provided by applying hydrophobic treatment to the paste toner is added to the toner surface]

Carriers: Polymer carriers with particle diameter 55 μm

[Styrene-acrylic copolymer (number-average molecular weight: 23,000, weight average molecular weight: 98,000, T g=78° C.) 30 wt % and granular magnetite (maximum magnetization 80 emu/g, particle diameter 0.5 μm) 70 wt % are mixed, kneaded, broken into fragments, and classified to produce carriers with average particle size 55 μm. When the magnetic characteristic is measured, saturated magnetization is 55 emu/g.]

Figure 2:
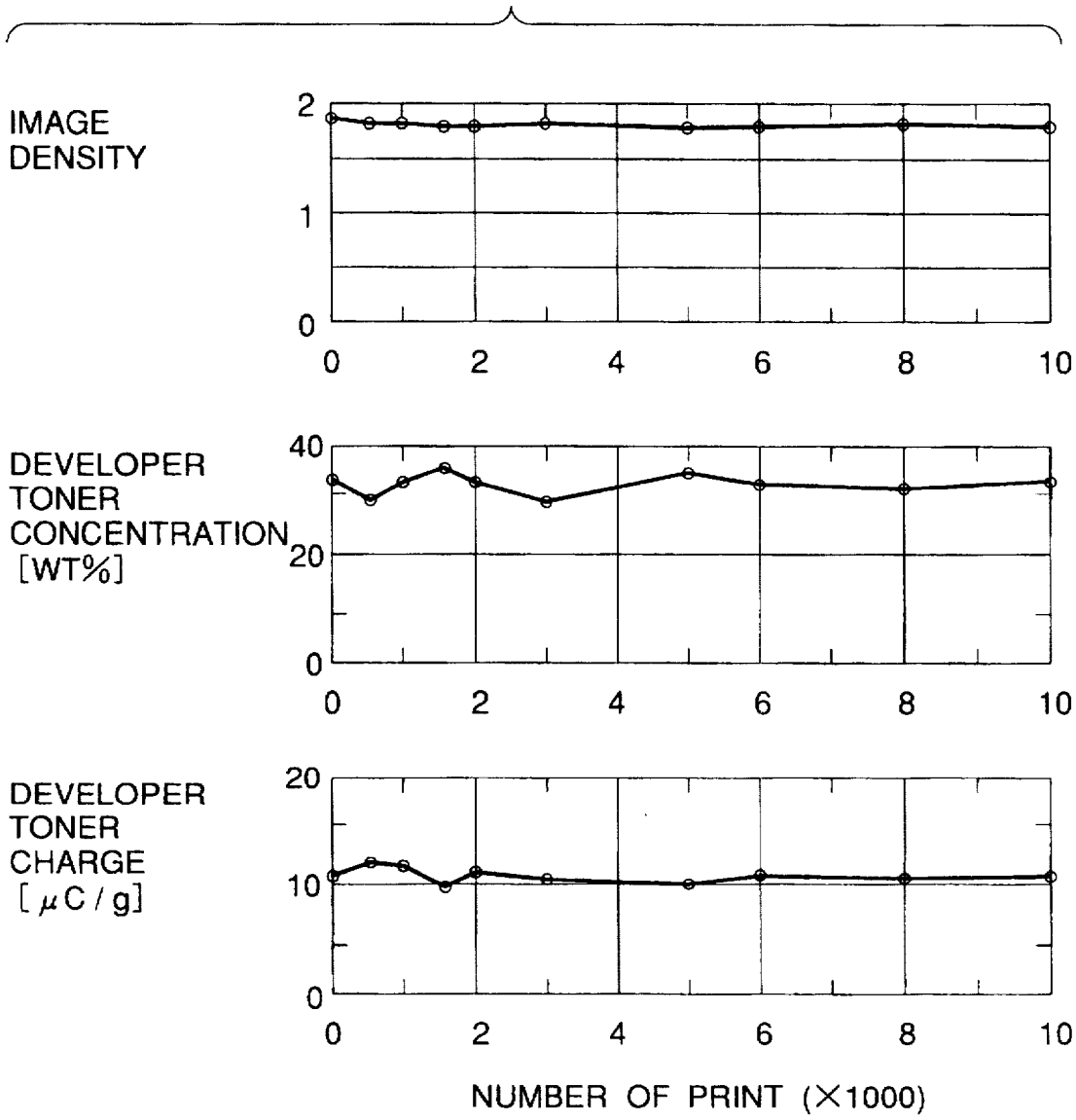
FIG. 2 is a graph to show changes in the image density, the toner concentration, and the toner charge amount in a print test carried out using the developing device shown in FIG. 1.

FIG. 2 shows the results of continuously printing 10,000 sheets of paper under such conditions.

As seen in the figure, the image density is almost constant and although the toner concentration is not controlled, the developer toner concentration and the developer toner charge amount also become almost constant values. Meanwhile, no toner clouds occur and images of good image quality can be provided.

Second Embodiment

Figure 3:
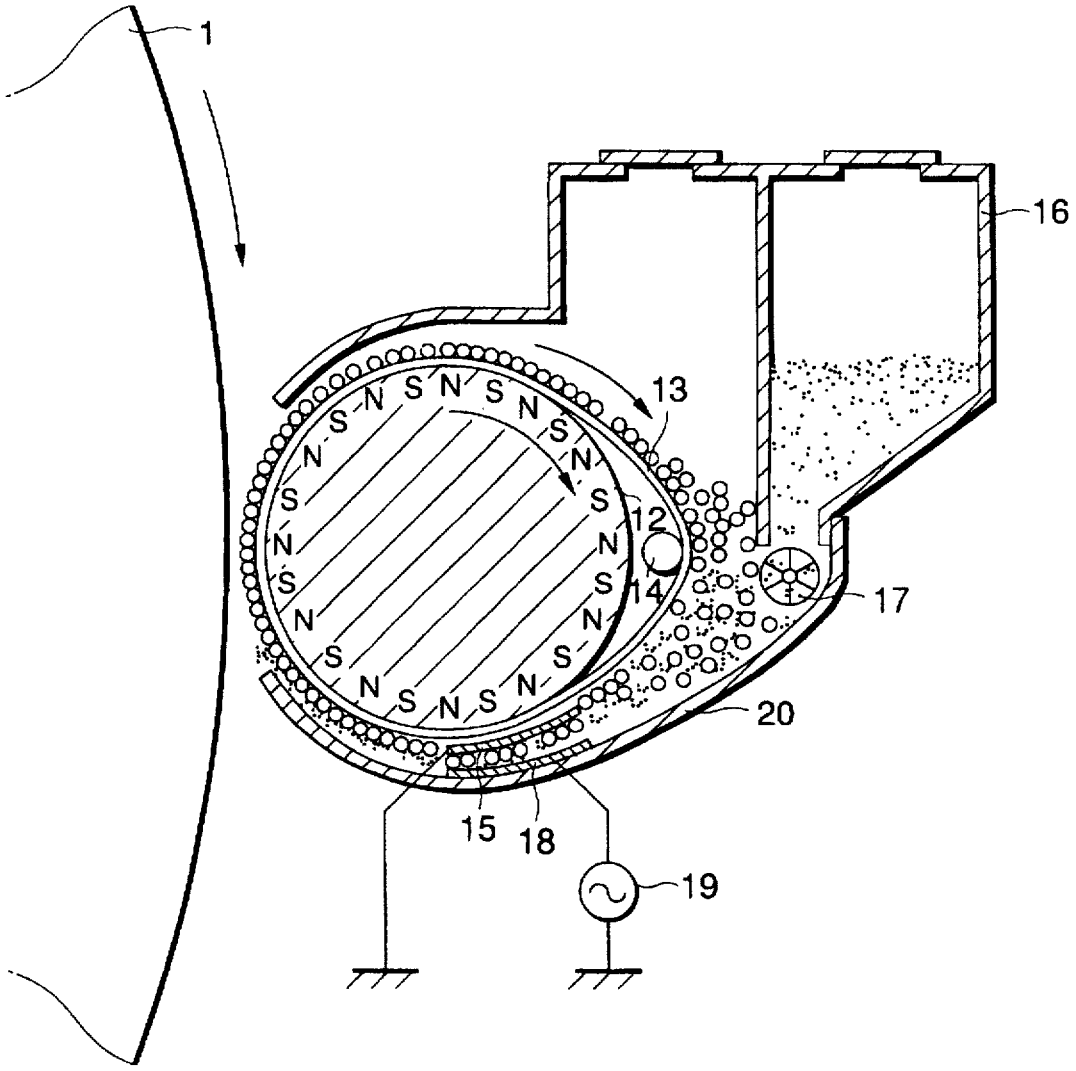
FIG. 3 is a schematic diagram to show the configuration of a developing device of second embodiment of the invention.

FIG. 3 is a schematic diagram to show the configuration of a developing device of second embodiment of the invention.

The developing device comprises a nonmagnetic electrode member 15 disposed along the peripheral surface of a developer transport member 13 and a counter electrode 18 disposed facing the electrode member 15 and connected to an AC power supply 19 in place of the plate-like member 5 used with the developing device shown in FIG. 1. The electrode member 15 is electrically grounded.

The electrode member 15 can be used appropriately if it is a nonmagnetic conductive member; in the embodiment, both the electrode member 15 and the counter electrode 18 are made of aluminum.

The developing device is the same as that shown in FIG. 1 in other components.

In the developing device, when a developer passes through between the electrode member 15 and the counter electrode 18, the electrode member 15 is shaken by an electric field formed by AC voltage. Thus, excessive toner in the developer is screened out by shaking the electrode member 15 and only toner sufficiently charged and adhering to magnetic carriers is supported on the developer transport member 13 and is transported to a developing area. Therefore, as with the developing device shown in FIG. 1, the toner concentration and the toner charge amount become almost constant values, and a toner cloud problem can also be solved.

Third Embodiment

Figure 4:
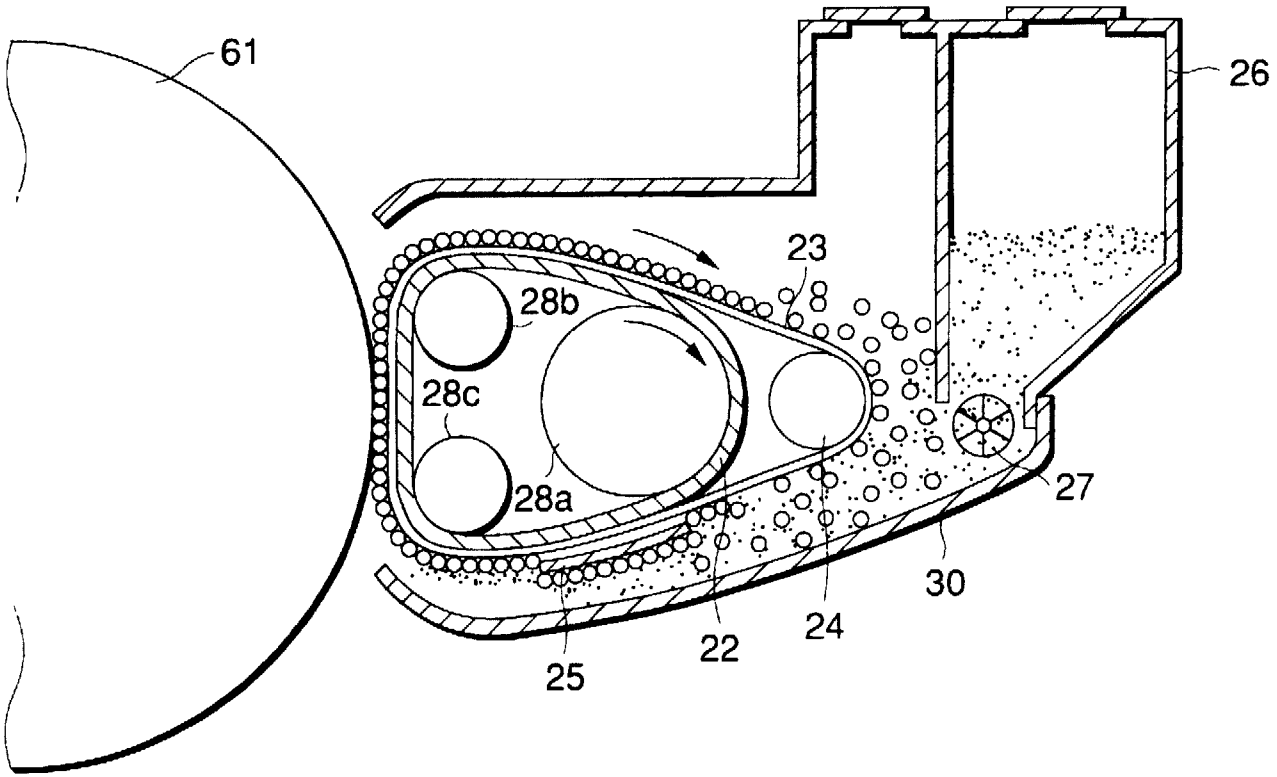
FIG. 4 is a schematic diagram to show the configuration of a developing device of third embodiment of the invention.

FIG. 4 is a schematic diagram to show the configuration of a developing device of third embodiment of the invention.

The developing device is placed facing a small-sized image carrier 61 being 20 mm in diameter and comprises a magnetic field generation member 22 made of an endless sheet magnet 80 mm in outer periphery magnetized at 1.5-mm magnetic pole pitches in place of the magnetic field generation roller 2 of the developing device shown in FIG. 1. The magnetic field generation member 22 is placed on a support roller **28*a* and support rollers 28*b* and 28*c* facing the image carrier 61 with the magnetic field generation member 22 between, and makes a circumferential rotation move in the arrow direction shown in FIG. 4 as the support roller 28*a*** is rotated.

The magnetic field generation member 22 is a flexible sheet 0.8 mm thick and the magnetic force of the magnetic poles is 18 mT on a developer transport member 23. A developer layer formed on the developer transport member 23 is 0.4 mm thick and the spacing between the developer transport member 23 and the image carrier 61 is also adjusted to about 0.4 mm.

The developing device is the same as that shown in FIG. 1 in other components.

In the developing device, the developer transport member 23 is supported by the support rollers **28*b* and 28*c* so as to come in contact with the image carrier 61 via a developer and even if the small image carrier 61** is used, a sufficient developing area can be provided.

When the developing device is used to continuously print 10,000 sheets of paper, a stable image density is obtained as mentioned above, the developer toner concentration becomes almost 30 wt %, and the toner charge amount also becomes almost 10 μC/g; good results are obtained.

Fourth Embodiment

Figure 5:
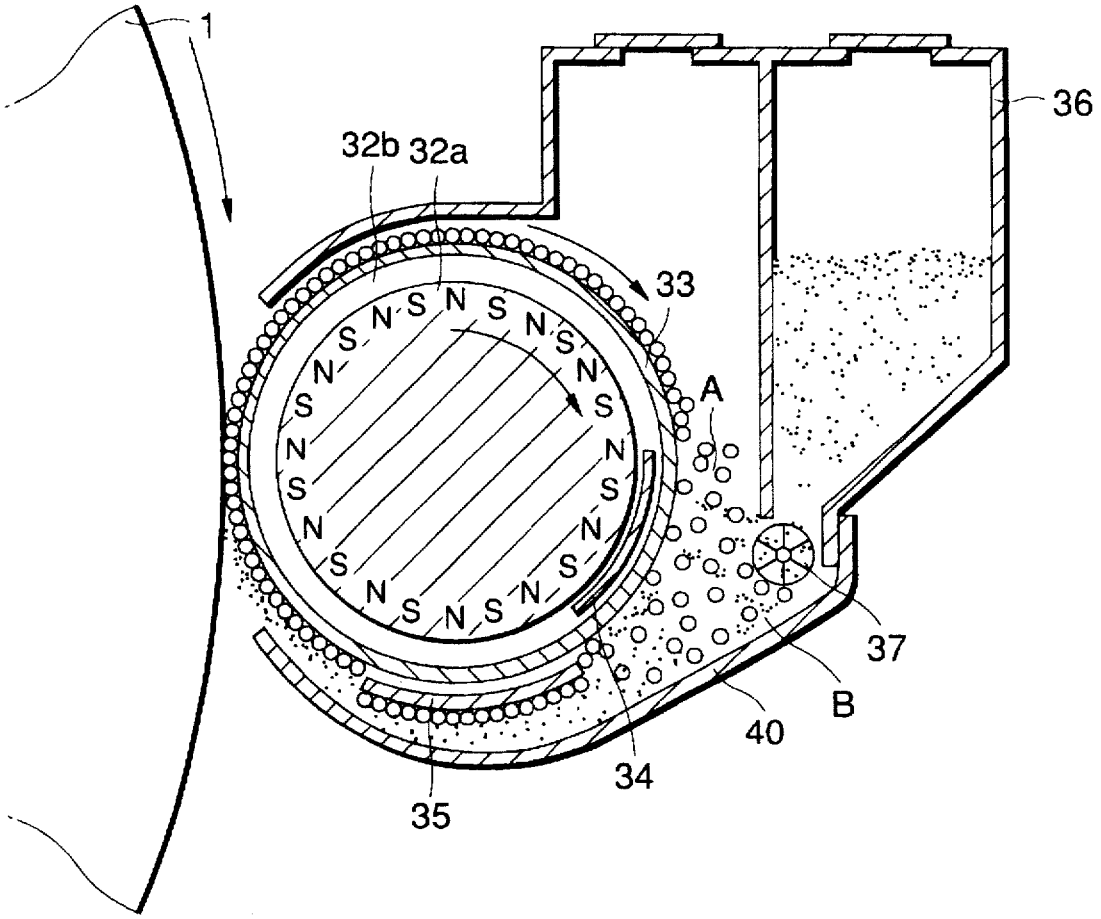
FIG. 5 is a schematic diagram to show the configuration of a developing device of fourth embodiment of the invention.

FIG. 5 is a schematic diagram to show the configuration of a developing device of fourth embodiment of the invention.

The developing device comprises a high-magnetic-permeability permalloy plate 34 fixedly supported along the peripheral surface of a magnetic field generation roller 32*a* in place of the magnetic field generation roller 2 and the guide member 4 used with the developing device shown in FIG. 1. A hollow cylindrical developer transport member 33 is disposed outside the magnetic field generation roller 32*a* with a gap 32*b* therebetween, and is rotated as the magnetic field generation roller 32*a* is driven. The developer transport member 33 comprises a synthetic resin layer formed surrounding a cylindrical core material and is made of a comparatively rigid member 0.1–0.3 mm thick.

The developing device is the same as that shown in FIG. 1 in other components.

In the developing device, in area A into which a magnetic brush after developing is recovered, the permalloy plate 34 can prevent the magnetic force of the magnetic field generation roller 32*a* from acting on the developer transport member 33. Thus, a magnetic restraint force in the recovery area A and agitation area B is decreased and the developer can be stripped off and agitated well.

Fifth Embodiment

Figure 6:
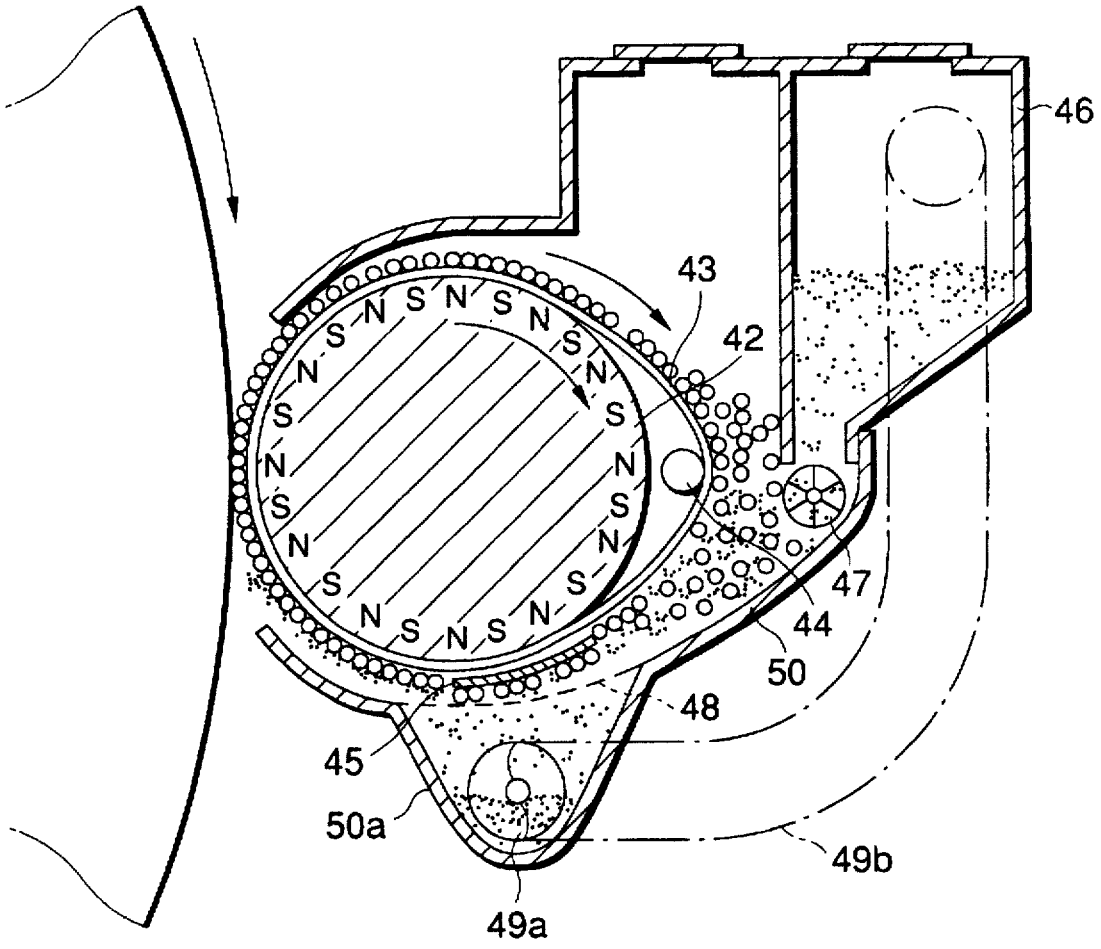
FIG. 6 is a schematic diagram to show the configuration of a developing device of fifth embodiment of the invention.

FIG. 6 is a schematic diagram to show the configuration of a developing device of fifth embodiment of the invention.

The developing device comprises a mesh screen 48 having a plurality of minute openings disposed below a plate-like member 45 disposed in the proximity of a developer transport member 43, and below the mesh screen 48, a toner storage section 50*a* for once storing toner, an auger 49*a* for transporting the toner in the toner storage section 50*a* in the axial direction of a magnetic field generation roller 42, and a toner transport passage 49*b* for guiding the toner transported by the auger 49*a* into a toner hopper 46.

The mesh screen 48 has a plurality of openings of about 44 μm for blocking carriers and allowing toner to drop smoothly.

The developing device is the same as that shown in FIG. 1 in other components.

In the developing device, excessive toner in a developer agitated in the vicinity of the plate-like member 45 passes through the mesh screen 48 and drops into the toner storage section 50*a* by gravitation. The dropped toner is transported by the auger 49*a* and is restored via the toner transport passage 49*b* to the toner hopper 46, whereby the toner separated by the plate-like member 45 is not again deposited on the developer and the developer toner concentration is furthermore stabilized.

When 10,000 sheets of paper are continuously printed by mixing line and solid images and changing image areas in the developing device, the image density, the developer toner concentration, and the toner charge amount do not change and good results can be produced.

Sixth Embodiment

Figure 7:
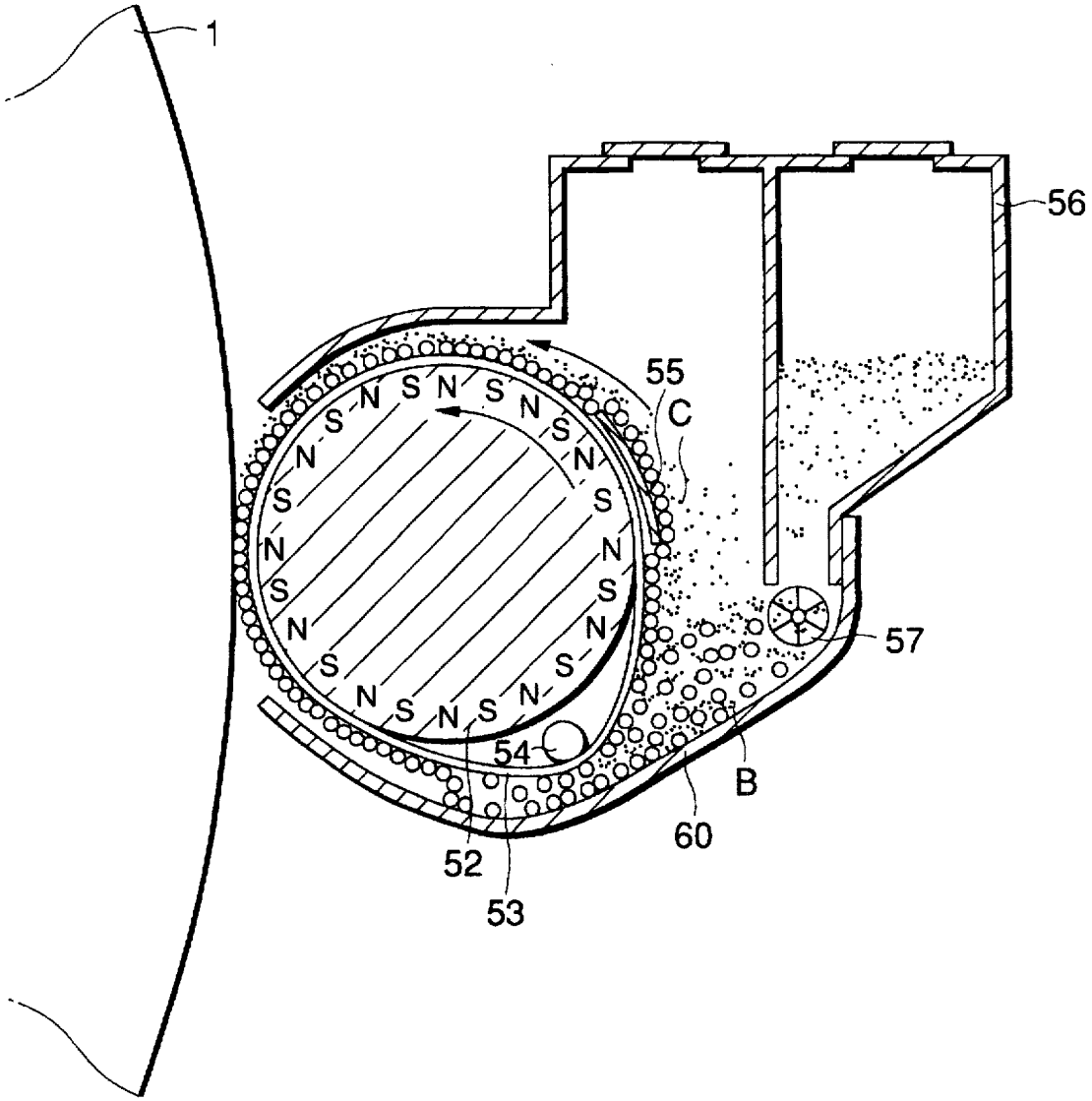
FIG. 7 is a schematic diagram to show the configuration of a developing device of sixth embodiment of the invention.

FIG. 7 is a schematic diagram to show the configuration of a developing device of sixth embodiment of the invention.

In the developing device, the move direction of a magnetic field generation roller 52 and a developer transport member 53 is opposite to that in the developing device in FIG. 1. A guide member 54 and a plate-like member 55 are placed from the upstream side of the move direction of the developer transport member 53 and the guide member 54 is fixedly supported in the lower part of a housing 60 and the plate-like member 55 is fixedly supported in the upper part of the housing 60.

The developing device is the same as that shown in FIG. 1 in other components.

In the developing device, the plate-like member 55 is positioned in the upper part of the housing 60 and excessive toner separated in area C naturally drops by gravitation and is restored to toner supply area B. Thus, the excessive toner is separated and agitated with the developer smoothly and can be prevented from remaining in the housing.

When the developing device is used to continuously print 10,000 sheets of paper, the image density, the developer toner concentration, and the toner charge amount do not change and good results can be produced. The plate-like member 55 enables excessive toner to be separated from the developer and recycled by the simple structure.

Seventh Embodiment

Figure 8:
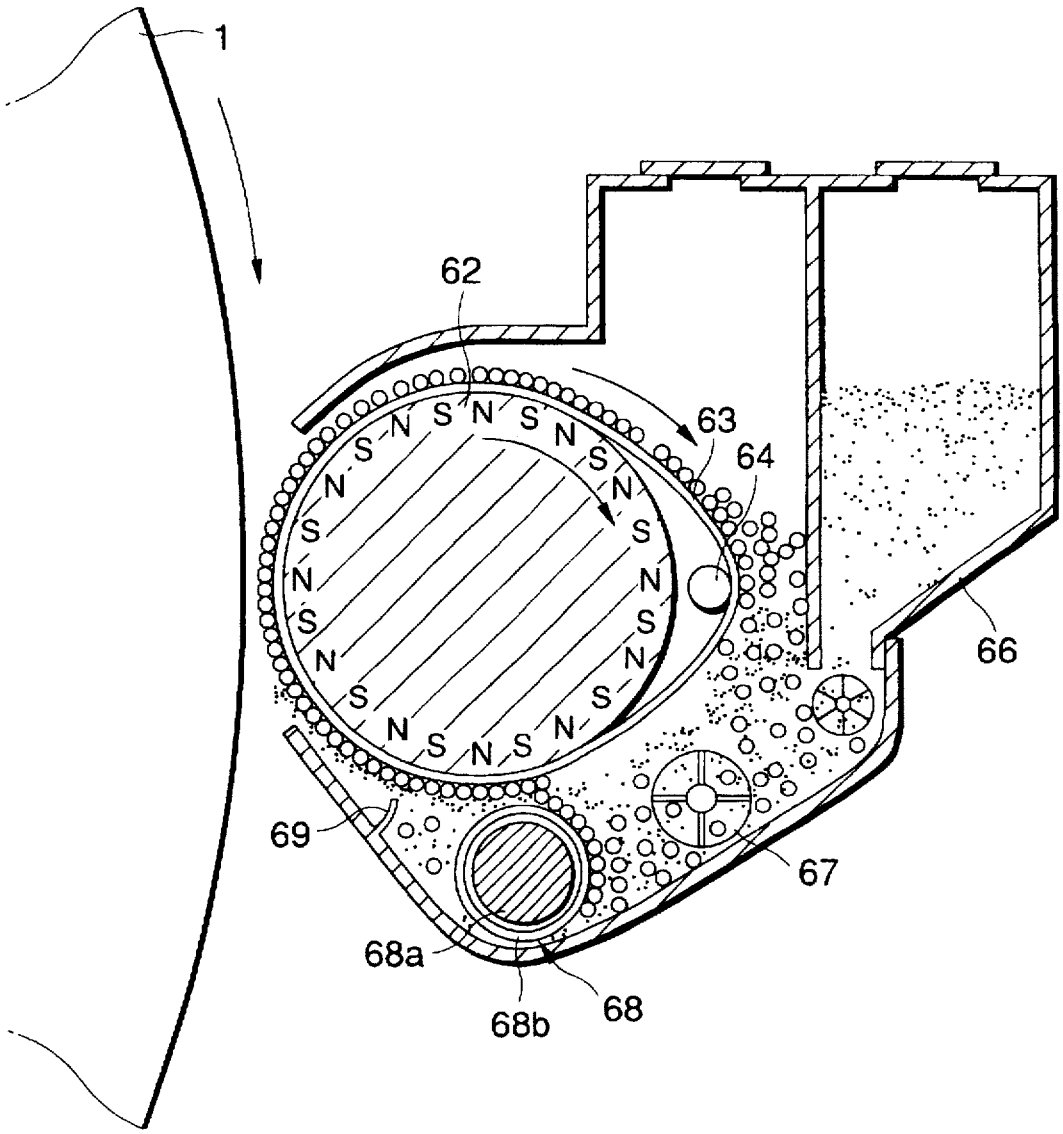
FIG. 8 is a schematic diagram to show the configuration of a dual-component magnetic brush developing device of seventh embodiment of the invention.

FIG. 8 is a schematic diagram to show the configuration of a dual-component magnetic brush developing device of seventh embodiment of the invention.

The dual-component magnetic brush developing device has a magnetic field generation roller 62, a developer transport member 63 supported pivotally on the outside of the magnetic field generation roller 62, and a guide member 64 for guiding the developer transport member 63 so that the developer transport member 63 moves away from the magnetic field generation roller 62, which are the same as those used with the developing device shown in FIG. 1. However, the amount of toner supplied from a toner hopper 66 is set so as to maintain the toner concentration in a developer to a value appropriate for developing, and an excess of toner is not supplied. A first developer agitation member 67 and a second developer agitation member 68 are disposed downstream from the position of the guide member 64 in the move direction of the developer transport member 63.

The first developer agitation member 67 is a paddle supported rotatably in the axial direction and is rotated, thereby agitating a developer replenished with toner from the toner hopper 66.

The second developer agitation member 68 has a magnetic roll 68*a* fixedly supported and a cylindrical sleeve 68*b* supported rotatably outside the magnetic roll 68*a*. It attracts a developer on the sleeve 68*b* by a magnetic field of the magnetic roll 68*a* and transports the developer while agitating it by rotation of the sleeve 68*b*.

Magnetic poles of the magnetic roll 68*a* are an alternating pattern of magnetized N and S poles spaced 3.5 mm apart on the peripheral surface, and the magnetic flux density is 25 mT on the surface of the sleeve 68*b*. The sleeve 68*b*, which is rotated at a peripheral speed of 200 mm/s, is placed facing the developer transport member 63 with a gap of 1.5 mm therebetween.

Numeral 69 is a partition plate for preventing toner from leaking out from the housing.

In the developing device, a developer attracted magnetically on the peripheral surface of the developer transport member 63 and passing through the area opposed to an image carrier 1 (developing area) arrives at the position of the guide member 64 and is stripped off from the developer transport member 63 because the magnetic field in the vicinity of the surface of the developer transport member 63 is decreased. In an area little affected by the magnetic field of the magnetic field generation roller 62, the developer is replenished with new toner from the toner hopper 66 and agitated by the first developer agitation member 67, then sent onto the sleeve 68*b* of the second developer agitation member 68. The developer attracted on the sleeve **68*b* is transported by rotation of the sleeve 68*b* and a magnetic brush of the developer formed like ears tumbles in accordance with the direction of the magnetic force line and again rises up immediately after it tumbles (so-called tumbling occurs); agitation and toner charging are performed. The sufficiently agitated developer is again supplied from the sleeve 68*b* to the developer transport member 63** and sent to the developing area.

Since the developer stripped off from the developer transport member 63 is mixed and agitated with toner in the area little affected by the magnetic field, magnetic carriers are dispersed and all surface areas thereof can come in contact with the toner; the toner is charged sufficiently and the toner concentration becomes uniform.

The developer attracted on the developer transport member 63 moves with the magnetic poles of the magnetic field generation roller 62, thus no tumbling occurs on the developer transport member 63 and dirt, etc., in the device caused by cloud generation scarcely occurs. Further, the developer is stripped off from the developer transport member 63 because of a decrease in the magnetic filed, thus a stress acting on the developer is reduced and degradation of the developer can be prevented.

The second developer agitation member 68 used with the developing device of the embodiment has the magnetic roll **68*a* fixed and the sleeve 68*b* rotated, but may have the magnetic roll 68*a* rotated and the sleeve 68*b* fixed or may have both the magnetic roll 68*a* and the sleeve 68*b*** rotated.

As we have discussed, the dual-component magnetic brush developing device according to the invention strips off a developer transported as the magnetic poles of the magnetic field generation member move by reducing the magnetic field produced by the magnetic poles and replenishes the developer with new toner, so that degradation of the developer is prevented and agitation of the developer and charging of the toner can be performed sufficiently.

An excess of toner it once supplied to the developer stripped off from the developer transport member, then excessive toner is separated before developing, whereby the toner concentration of the developer transported to the developing area and the toner charge amount can be maintained almost constant by a simple structure, and a stable image density can be maintained over a long term. Thus, the need for the complicated toner concentration control means formerly required is eliminated and a decrease in costs and downsizing the device are enabled.

What is claimed is:

1. A dual-component magnetic brush developing device using a dual-component developer containing magnetic carriers and toner electrically attracted to the magnetic carriers for selectively transferring the toner to an electrostatic latent image formed on an image carrier for visualizing the latent image, said dual-component magnetic brush developing device comprising:

a magnetic field generation member being formed with a plurality of magnetic poles almost equally spaced from each other on a peripheral surface and being supported so that the peripheral surface makes a circumferential rotation move;

a developer transport member being supported outside said magnetic field generation member for circumferential rotation and moving together with said magnetic field generation member at least in a developing area facing the image carrier in the proximity thereof;

toner supply means for supplying an excess of new toner to the magnetic carriers supported on said developer transport member and passing through the developing area;

magnetic field reduction means for reducing a magnetic field strength in the vicinity of a surface of said developer transport member by an agitation section for agitating the developer to which the excessive toner is supplied; and a plate-like member disposed downstream from the agitation section in a circumferential rotation direction of said developer transport member and placed in contact with or in the proximity of said developer transport member along said developer transport member where the developer is magnetically attracted to said magnetic field generation member through said plate-like member and charge-failure toner is liberated from the developer as the developer is agitated by a magnetic force on said plate-like member, forming a stable magnetic brush on said developer transport member, wherein said stable magnetic brush is transported to a developing area for transfer to an electrostatic latent image as said developer transport member makes a circumferential rotation.

2. The dual-component magnetic brush developing device as claimed in claim 1, wherein said magnetic field reduction means is a guide member for guiding said developer transport member so that said developer transport member moves away from a surface of said magnetic field generation member.

3. The dual-component magnetic brush developing device as claimed in claim 1, wherein said magnetic field reduction means is a magnetic member being placed between said magnetic field generation member and said developer transport member.

4. The dual-component magnetic brush developing device as claimed in claim 1 wherein said magnetic field generation member comprises an alternating pattern of magnetized S and N poles almost equally spaced 3 mm or less apart in a circumferential direction.

5. The dual-component magnetic brush developing device as claimed in claim 1 further including means for shaking said plate-like member.

6. The dual-component magnetic brush developing device as claimed in claim 1 further including toner recovery and transport member for recovering toner separated by said excessive toner separation means and transporting the toner to the agitation section.

7. The dual-component magnetic brush developing device as claimed in claim 1, wherein said excessive toner separation means is placed at a position where toner separated from the developer moves to the agitation section by gravitation.

8. The dual-component magnetic brush developing device as claimed in claim 1, wherein the toner excessively supplied to the developer passing through the developing area is supplied so that coverage percentage of toner to carriers is set in the range of 100% to 500%.

9. The dual-component magnetic brush developing device as claimed in claim 1, wherein said magnetic field generation member is a magnetic roller and wherein said developer transport member is an endless belt.

10. The dual-component magnetic brush developing device as claimed in claim 1, wherein said magnetic field generation member and said developer transport member are each an endless belt supported for circumferential rotation.

11. A dual-component magnetic brush developing device using a dual-component developer containing magnetic carriers and toner electrically attracted to the magnetic carriers for selectively transferring the toner to an electrostatic latent image formed on an image carrier for visualizing the latent image, said dual-component magnetic brush developing device comprising:

a magnetic field generation member being formed with a plurality of magnetic poles almost equally spaced from each other on a peripheral surface and being supported so that the peripheral surface makes a circumferential rotation move;

a developer transport member being supported outside said magnetic field generation member for circumferential rotation and moving together with said magnetic field generation member at least in a developing area facing the image carrier in the proximity thereof;

magnetic field reduction means for reducing a magnetic field near a surface of said developer transport member after the developer is supported on said developer transport member and passes through the developing area, and stripping off the developer from said developer transport member; and toner supply means for supplying a predetermined amount of toner to maintain toner concentration in the developer having a magnetic developer agitation member disposed downstream from said magnetic field reduction means in the move direction of said developer transport member, said magnetic developer agitation member having a magnetic roll fixedly supported and a cylindrical sleeve rotatably supported outside said magnetic roll, said magnetic developer agitation member attracts the developer on said sleeve by a magnetic field of said magnetic roll and the developer attracted on said sleeve is transported by rotation of said sleeve forming a magnetic brush of the developer that is supplied to said developer transport member and a developing area.

12. The dual-component magnetic brush developing device as claimed in claim 11 wherein said magnetic field generation member comprises an alternating pattern of magnetized S and N poles almost equally spaced 3 mm or less apart in a circumferential direction.

13. The dual-component magnetic brush developing device as claimed in claim 11, further including a paddled developer agitation member disposed downstream from said magnetic field reduction means in the move direction of said developer transport member, said paddled developer agitation member having a paddle rotatably supported in an axial direction and rotated, agitating the developer replenished with toner from a toner hopper toward said magnetic developer agitation member.

* * * * *